US006669039B1

(12) United States Patent
Moilanen et al.

(10) Patent No.: US 6,669,039 B1
(45) **Date of Patent: *Dec. 30, 2003**

(54) LOADING CRANE AND ITS CONTROL SYSTEM

(75) Inventors: Arto Moilanen, Salo (FI); Asko Repo, Peitilä (FI); Jorma Renvall, Salo (FI)

(73) Assignee: Loglift Oy AB, Salo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,695

(22) Filed: Dec. 3, 1998

(30) Foreign Application Priority Data

Dec. 17, 1997 (FI) ..... 974544

(51) Int. Cl.[7] ..... B66C 13/12; B66C 13/54
(52) U.S. Cl. ..... 212/287; 212/290
(58) Field of Search ..... 212/285, 287–290

(56) References Cited

U.S. PATENT DOCUMENTS

| | | | | |
|---|---|---|---|---|
| 2,572,029 A | * | 10/1951 | Huston | 212/290 |
| 2,781,134 A | * | 2/1957 | Weir et al. | 212/285 |
| 3,559,817 A | * | 2/1971 | Brown | 212/285 |
| 3,601,169 A | * | 8/1971 | Hamilton et al. | 212/281 |
| 3,605,561 A | * | 9/1971 | Lado | 212/287 |
| 3,965,771 A | | 6/1976 | Macdonald | 74/479 |
| 4,140,200 A | | 2/1979 | Tucek | 180/77 H |
| 4,238,008 A | | 12/1980 | Higgins et al. | 180/328 |
| 4,664,220 A | | 5/1987 | Ruhter et al. | 180/315 |
| 5,112,184 A | | 5/1992 | Tapper et al. | 414/728 |

FOREIGN PATENT DOCUMENTS

| | | |
|---|---|---|
| FR | 2197478 | 3/1974 |

* cited by examiner

*Primary Examiner*—Eileen D. Lillis
*Assistant Examiner*—R. B. Johnson
(74) *Attorney, Agent, or Firm*—Ladas & Parry

(57) ABSTRACT

A control system for a loading crane provided with a control site, the control system consisting of a control site for a crane operator, a directional control valve positioned external to the control site and arranged to control a hydraulic system of the crane to provide different operations of the crane, and a mechanical rod-driven control lever system influencing actuator spindles of the directional control valve for the control of the directional control valve from the control site of the crane. To provide an efficient control system, the directional control valve is arranged at the sides of the control site in such a way that the actuator spindles are in a substantially horizontal position.

7 Claims, 6 Drawing Sheets

LOADING CRANE AND ITS CONTROL SYSTEM

The invention relates to a control system for a loading crane provided with a control site, the control system consisting of a control site for a crane operator, a directional control valve positioned external to the control site and arranged to control a hydraulic system of the crane to provide different operations of the crane, and control means influencing actuator spindles of the directional control valve for the control of the directional control valve from the control site of the crane, whereby the control means are constituted by a mechanical rod-driven control lever system.

Such control systems are well-known at present in connection with timber cranes or bulk cranes, for instance. A basic control system of the prior art consists in that a directional control valve positioned outside a control cabin is controlled by means of wires. Control levers are then positioned either at both sides of the control site or at that side which faces the crane, and in a side door turning outwards. When an actuator spindle is controlled by wires, there is, however, always clearance and friction force inside a wire, which impair the control properties. In winter conditions, water may accumulate between the wire and a protecting tube, and frozen water makes the wire get stuck. Moreover, freezing may occur during a control movement and a stuck control lever may then cause a dangerous situation. In addition, the actuator spindles require special fasteners at the ends of the wires.

As a second example of the prior art technique may be mentioned a control system in which a directional control valve is positioned under the operator's seat. In this control system, control levers are articulated directly with the ends of actuator spindles. At a control site where the directional control valve is positioned under the operator's seat, problems with noise, heat and odour arise, caused by hot and pressurized hydraulic oil. In a control system of this kind, a movement of a control lever in relation to a movement of an actuator spindle is difficult to adjust so as to suit a movement of a hand. Other drawbacks are caused by hydraulic hoses of the directional control valve being led to actuator connections from the control cabin and by maintenance and adjusting steps, which are difficult to perform for a control valve positioned indoors.

As a third example may be mentioned electro-hydraulic pilot operation of a directional control valve. The valve may then be positioned freely with respect to a control site. A problem is, however, the complicatedness and the high price of the system.

As a fourth example of the prior art technique may be mentioned the control device disclosed in U.S. Pat. No. 4,140,200. Drawbacks of the control device are, however, a relatively complicated structure and an incomplete location and position of a directional control valve.

The object of the invention is to provide a control system by which the drawbacks of the prior art can be eliminated. This has been achieved by means of the control system of the invention, which is characterized in that the directional control valve is positioned external the control site in such a way that the actuator spindles are in a substantially horizontal position.

In comparison to the previously known systems, the invention has for instance the advantage that the amount of hydraulic hoses is smaller than in a model having a directional control valve positioned inside a control cabin, for instance. Easy maintenance and adjusting steps are also a remarkable advantage. A directional control valve mounted outdoors does not cause any noise, heat or odour problems in the control cabin. The control properties provided by mechanical levers are more accurate and more sensitive than those provided by wire control. Winter conditions do not have any detrimental influence on the operation of the mechanics. The directional control valve does not require any special fastenings for actuator spindles, but a standard directional control valve can be used. A movement of control levers in relation to a movement of an actuator spindle is easy to adjust by changing pivot points, by which measure a suitable movement of the control lever is provided. Advantage arises also from the fact that, in the invention, connecting rods of the control levers can be positioned for instance at the sides of the control cabin and connecting rods of pedals close to the floor of the control cabin. By this arrangement, more space is achieved and for instance a heating device of the control cabin can be positioned in this space. In addition, folding control levers provide security, because the levers folding by means of a link make it easier to leave and to enter the control site and also increase the operator's safety at work by preventing the lever from being moved by the body by mistake. Still an advantage of the invention arises from its simplicity and relatively low costs.

In the following, the invention will be described in greater detail by means of preferred embodiments shown in the attached drawing, whereby FIG. 1 is a side elevational view of a loading crane in accordance with the invention.

Figure 4:
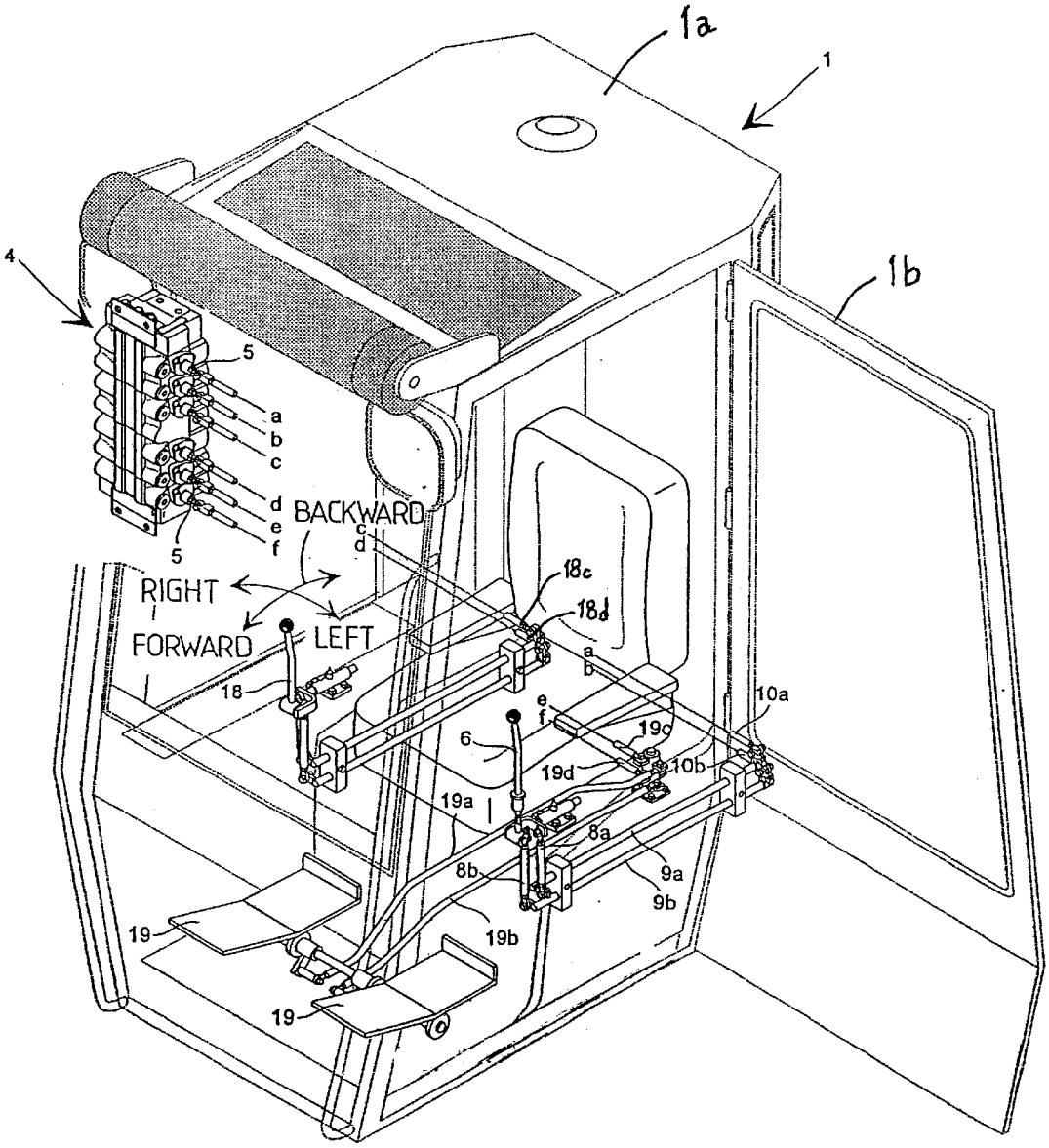
FIG. 4 is a diagrammatic perspective view of a control site of the loading crane.
Figure 4A:
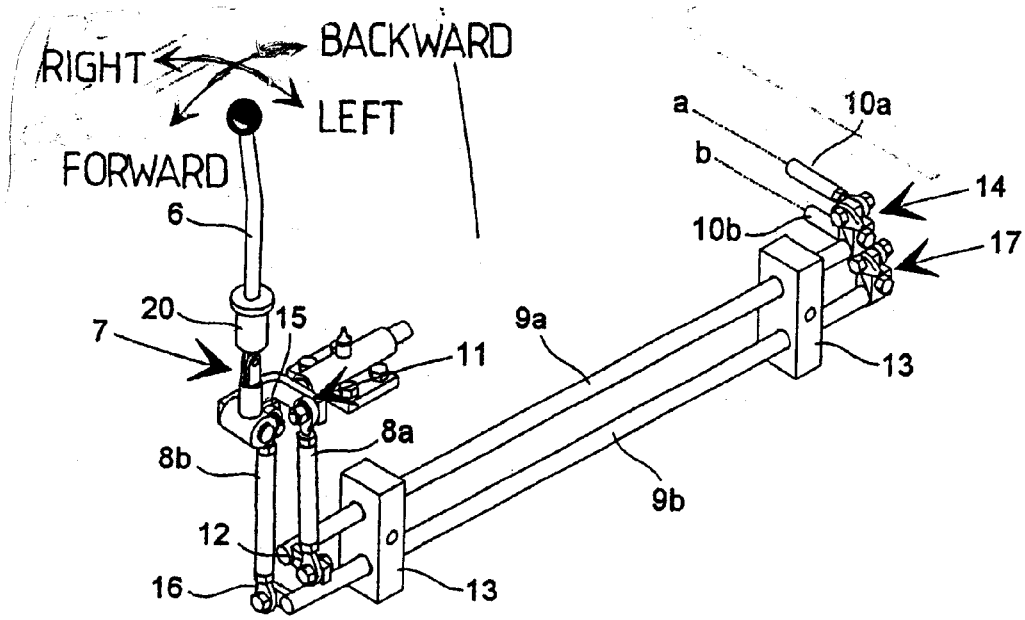

FIG. 4*a* is a perspective view, on enlarged scale, of a portion of a control arrangement in the control site of FIG. 4.

Figure 5:
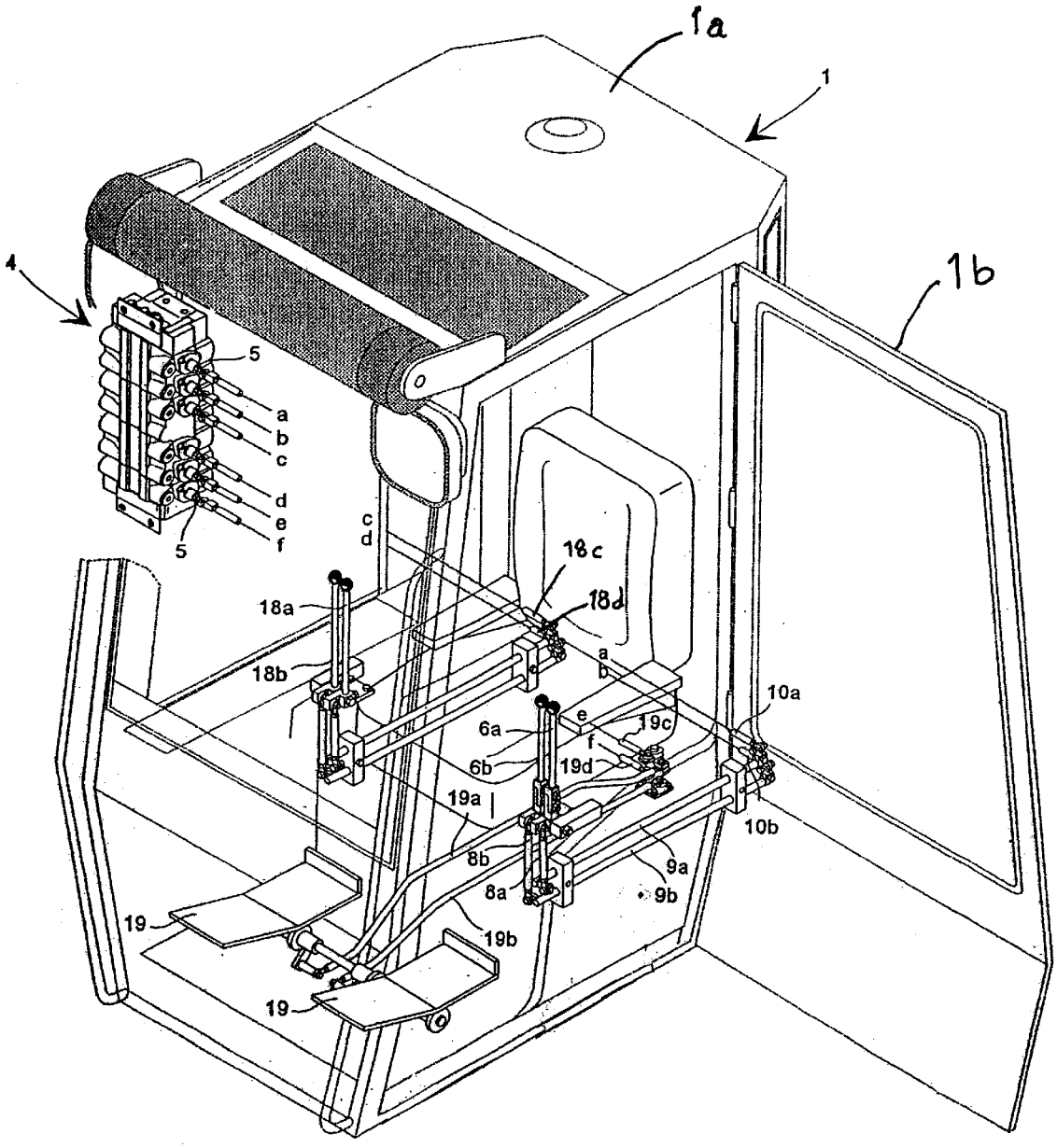

FIG. 5 is a perspective view similar to FIG. 4 of another embodiment of the control arrangement.

Figure 5A:
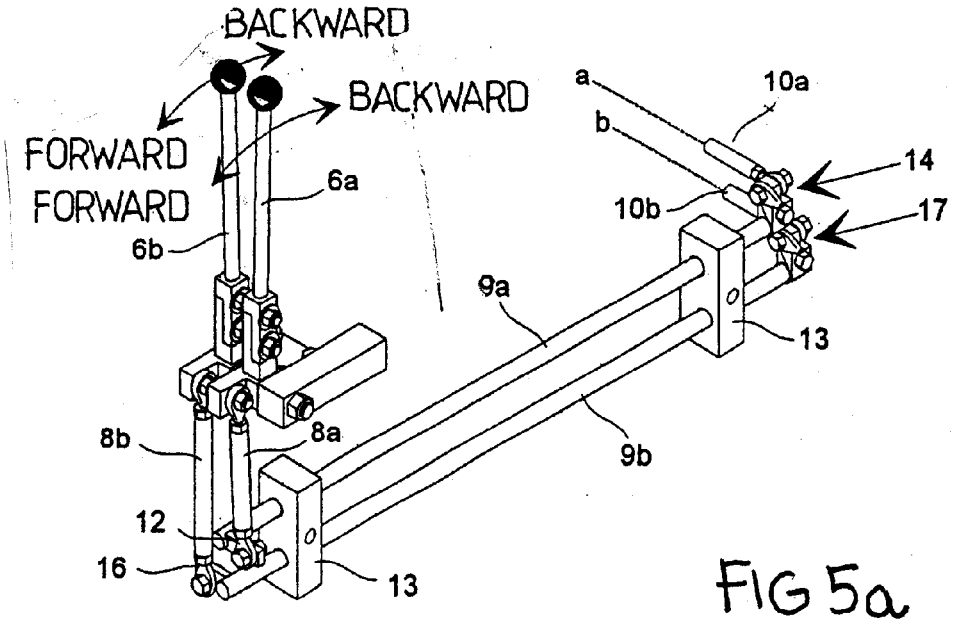

FIG. 5*a* is a perspective view, on enlarged scale, of a portion of the control arrangement in FIG. 5.

Figure 6:
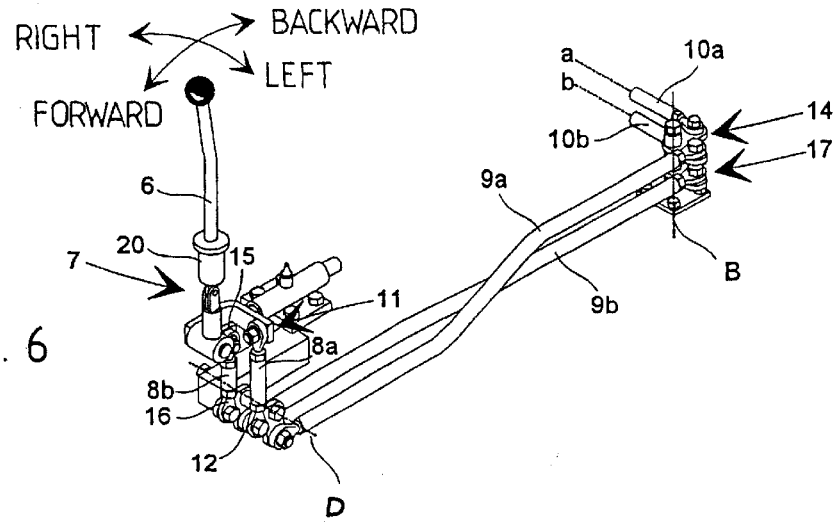
Figure 7:
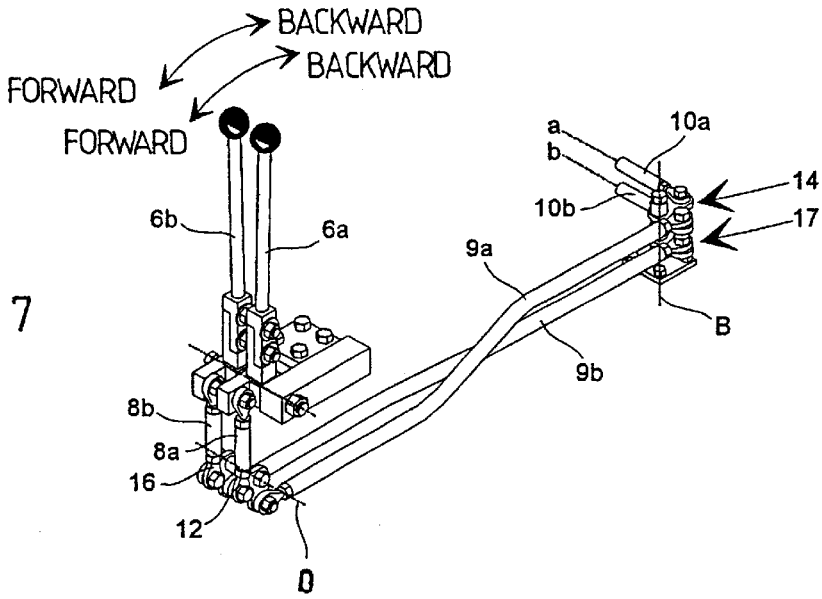
Figure 8:
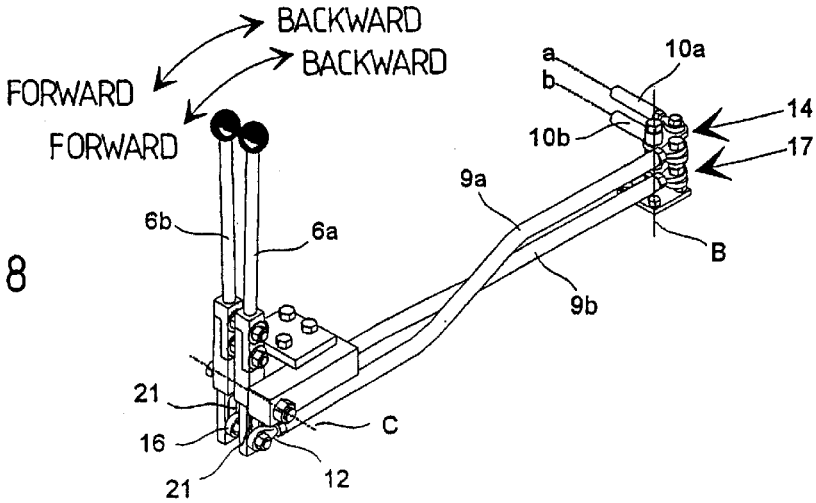

FIGS. 6–8 respectively illustrate different embodiments of the control arrangement.

Figure 2:
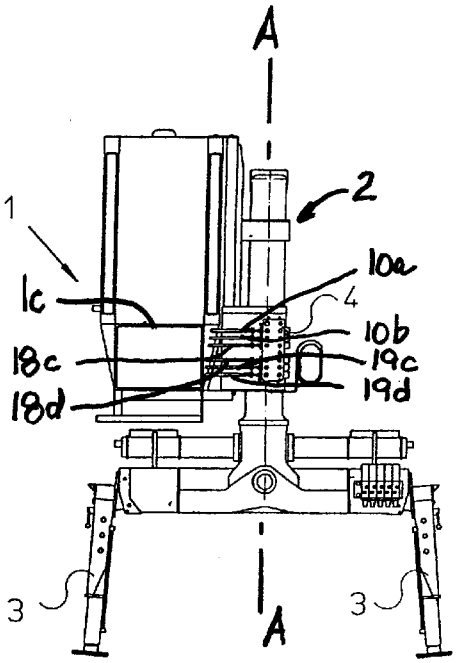
FIG. 2 is a rear elevational view of the loading crane in FIG. 1.
Figure 1:
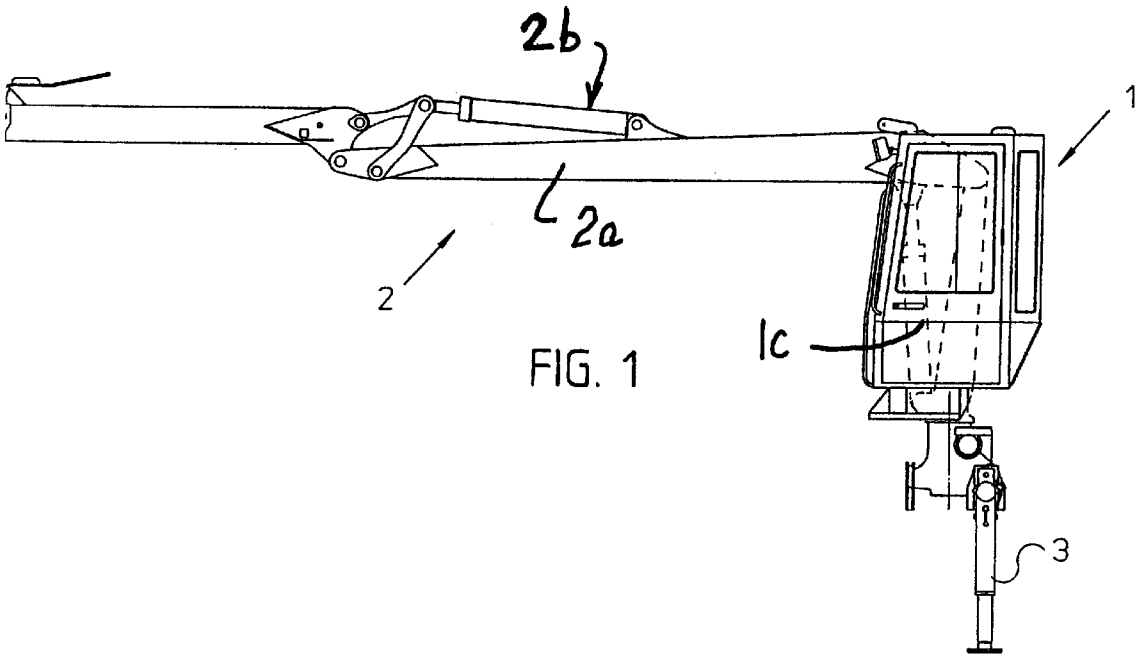
Figure 3:
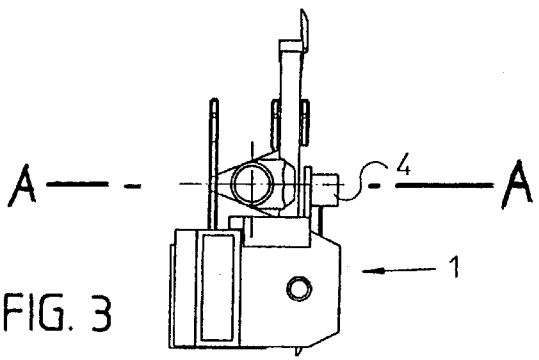
FIG. 3 is a top plan view of a portion of the loading crane.

FIGS. 1 to 3 show a loading crane, for instance a timber crane, from different directions. Such a crane can be arranged in connection with a lorry used for carrying timber, for instance. In FIGS. 1 to 3, reference numeral 1 indicates a control site of the crane, reference numeral 2 a boom system, reference numeral 3 folding stabilizers and reference numeral 4 a directional control valve. The boom system 2 comprises a boom 2*a* extending along an axis contained in a vertical plane A—A. As best seen in FIG. 2 the control site 1 is laterally offset from the boom and control valve 4 is aligned with the boom in vertical plane A—A. The purpose of the directional control valve 4 is to transmit control commands given by control means from inside the control site to actuators 2*b* of a hydraulic system of the boom system, for example. The control site 1 may be a control site provided with a control cabin 1*a* as shown or it can be an open control site.

FIG. 4 shows a first embodiment of an arrangement of the invention, the control system comprising a control means which includes two mechanical rod-driven control lever systems. For the sake of clarity, FIG. 4 does not show the boom system and the stabilizer construction of the crane, thanks to which the arrangement of the invention can be presented more clearly.

According to an essential idea of the invention, a directional control valve 4 is positioned external a control site so that actuator spindles 5 are in a substantially horizontal position and that control means are constituted by a mechanical rod-driven control lever system. The mechanical rod-driven control lever system comprises at least one control lever 6 positioned at the seat of the control site, within the control cabin and arranged to be turned by means of a lockable link 7 to an off and on-position, respectively. Further, the mechanical rod-driven control lever system comprises connecting rods, for instance first, second and third connecting rods 8*a*, 8*b*, 9*a*, 9*b*, and 10*a*, 10*b*, the third connecting the first and second connecting rods located within the control cabin rods 10*a*, 10*b* being at least partially within the control cabin being connected to the actuator spindles 5 of the directional control valve 4 external to the control cabin. The number of connecting rods depends on the implementation of the control system, naturally. The control lever and the connecting rods are joined together by linkage means.

The control system of FIG. 4 operates as follows, in principle. For the sake of clarity of FIG. 4, racks and supports relating to the mechanical rod-driven system are not shown. When the control lever 6 is moved to the left, the movement is transmitted to the connecting rod 8*a*, which is controlled by a ball joint 11 and to which is connected a ball joint 12. The ball joint 12 is also connected to the connecting rod 9*a* in such a way that a longitudinal movement of the connecting rod 8*a* is converted into a torsional movement of the connecting rod 9*a*. The torsional movement of the connecting rod 9*a* is brought via pedestals 13 to a link-lever structure 14 connected to the third connecting rod 10*a*. The link-lever structure 14 converts the torsional movement of the second connecting rod 9*a* into a longitudinal movement of the third, connecting rod. The third connecting rod is connected to that actuator spindle 5 of the directional control valve 4 which is arranged to provide a turn to the left and which in FIG. 4 is the actuator spindle 5*a*. The actuator spindle is pulled outwards, caused by a movement of the connecting rod 10*a*, because the link-lever structure 14 turns to the left in this situation, seen from behind the control site.

When the control lever 6 is pushed forward, the ball joint 15 rises upwards and transmits the movement by means of a longitudinal movement of the connecting rod 8*a* to a ball joint 16. The ball joint 16 converts the movement into a torsional movement of the connecting rod 9*b*, this torsional movement proceeding via the pedestals 13 forward to a link-lever structure 17, which turns to the left, seen from behind the control site, and pulls the actuator spindle 5*b* outwards by means of the connecting rod 10*b*, which makes the boom system move far away. The longitudinal movements of the connecting rods are, of course, to-and-fro movements, and also the torsional movements are to-and-fro movements depending on the movement of the control lever.

A second control lever 18 also positioned at the seat of the control site within the control cabin operates in a similar manner to control lever 6 to move rod a 18*c*, 18*d* to influence actuator spindles 5*c*, 5*d*. Movements of pedals 19 are brought by means of a rod drive 19*a* to 19*d* of the mechanical lever system to the actuator spindles 5 of the directional control valve 4 which is positioned external to the control cabin in the same way. By means of the lockable link 7 the control lever 6 can be folded to a horizontal off-position and to a vertical on-position, as described above. The locking is carried out for instance by means of a sliding sleeve 20, which in its lower position locks the link so that the control lever is not able to fold to the horizontal position. The movements of the control levers are marked in the figure by means of arrows.

FIG. 5 shows a second embodiment of the control system of the invention, in principle. This embodiment uses two mechanical rod-driven control lever systems such that four control levers are in use. In principle, the implementation and operation of the embodiment of FIG. 5 are similar to those described above in connection with FIG. 4. The only difference is that control commands are provided by means of four control levers positioned within the control cabin in the embodiment of FIG. 5, while the embodiment of FIG. 4 uses two levers. The same reference numerals as in FIG. 4 are used in FIG. 5 for identical items. In the embodiment of FIG. 5, the control levers 6*a*, 6*b* and 18*a*, 18*b* move back and forth only.

FIGS. 6 to 8 show different additional embodiments of the mechanical rod-driven control lever systems according to the FIGS. 4 and 5. FIG. 6 shows an embodiment of the 2-lever control such that only one control lever is shown in FIG. 6. In the embodiment of FIG. 6, the rods 8*a* and 8*b* are brought downwards in the same way as in the embodiment of FIG. 4. A to-and-fro movement of the rods 8*a*, 8*b* is transmitted to the rods 9*a*, 9*b* by means of levers rotating about a horizontal axis D drawn by broken lines. From this arrangement follows that the rods 9*a*, 9*b* moves back and forth, while they in the embodiment of FIG. 4 rotate about their longitudinal axis. The to-and-fro movement of the rods 9*a*, 9*b* is transmitted further to the rods 10*a*, 10*b* by means of levers rotating about a vertical axis B.

FIG. 7 illustrates an additional embodiment of the 4-lever control according to FIG. 5 in the same manner as FIG. 6, whereby the movement of the rods 9*a*, 9*b* is a to-and-fro movement, instead of being torsional as in the embodiment of FIG. 5. The details of the embodiment of FIG. 7 correspond to the details of the embodiment of FIG. 6.

FIG. 8 shows a simple, additional embodiment to the embodiment of FIG. 7. In the embodiment of FIG. 8, links 12 and 16 are connected directly to the ends of control levers below a horizontal axis C drawn by broken lines. It is clear that the links may also be situated above the axis. In this embodiment as well, the rods 9*a*, 9*b* move back and forth. The lower ends of the control levers 6*a*, 6*b*. of FIG. 8 comprise slots 21 for the links 12, 16. The location of the ends of the rods 9*a*, 9*b* with respect to the horizontal axis C can be adjusted by moving the links 12 and 16 in their slots. The result is an adjustable transmission ratio of the lever system. If the operator desires accurate movements of the crane and a loading means, the links may be moved closer to the horizontal axis, which makes the movement of the rods 9*a*, 9*b*, 10*a*, 10*b* controlling a directional control valve smaller with respect to the movement of a control lever. On the other hand, if speed is required, the links 12 and 16 are moved farther away from the horizontal axis, which makes the movement of the rods controlling the directional control valve bigger with respect to the movement of the control lever.

The above embodiments of the invention are by no means intended to limit the invention, but the invention can be modified fully freely within the scope of the claims. Accordingly, it is clear that an embodiment of the invention or its details do not necessarily need to be just as described in the figures, but solutions of other kinds are also possible. Though the figures show a crane having a control site at its left side seen from behind, it is clear that the control site may also be located at the right side of the crane within the scope of the invention. Moreover, it is clear that the connecting rods are led out through the walls of the control cabin in such a way that the sounds of the control valve are insulated outside of the control cabin and the heat is insulated inside of the control cabin. The insulations may naturally be carried out in very many different ways.

What is claimed is:

1. A loading crane, comprising a boom, a control site having a seat for a crane operator, said control site being laterally offset from said boom, a directional control valve supported at one side of said control site to be substantially in alignment with said boom, said directional control valve being constructed to hydraulically control the crane to provide different operations of the crane, and control means for influencing actuator spindles of the directional control valve for the control of the crane, said control means comprising a control lever arrangement adjacent to said operator seat for being operated by the operator, and a mechanical rod-driven control lever system having one end connected to said lever arrangement and an opposite end in operative engagement with the directional control valve such that the actuator spindles are in a substantially horizontal position, wherein said control lever arrangement comprises a control lever positioned at the operator seat for pivotable movement left and right and forward and backward, said mechanical rod-driven control lever system comprises a first pair of longitudinally movable connecting rods, a first pair of ball joints connecting said control lever to said first pair of connecting rods to transmit longitudinal movements to said first pair of connecting rods in correspondence with direction of pivotable movement of said control lever, a second pair of connecting rods, a second pair of ball joints connecting said second pair of connecting rods to said first pair of connecting rods to produce torsional movement of said second pair of connecting rods in correspondence with longitudinal movement of said first pair of connecting rods, and a third pair of connecting rods connected to said second pair of connecting rods to be moved longitudinally to and fro upon torsional movement of said second pair of connecting rods, said third pair of connecting rods being connected to said actuating spindles of said directional control valve.

2. The loading crane according to claim 1, wherein the mechanical rod-driven control lever system comprises at least one control lever positioned at the operator seat and arranged to be turned by means of a lockable link to an off-position and an on-position, respectively.

3. The loading crane according to claim 1, wherein said control site includes an operator cabin, the directional control valve being located outside said cabin, said cabin having an opening through which a portion of the control lever system extends from within said cabin to outside said cabin and to said directional control valve.

4. The loading crane according to claim 1, wherein said control site comprises a cabin having an opening atone side thereof, said directional control valve being disposed at an opposite side of said cabin.

5. The loading crane according to claim 4, wherein said boom and said directional control valve are substantially aligned in a vertical plane.

6. The loading crane according to claim 1, wherein said directional control valve is substantially aligned with said boom in a vertical plane.

7. The loading crane according to claim 1, wherein said control lever is movable between a horizontal off position and a vertical operative position, said control means comprising a lockable link for selectively locking the control lever in the off-position.

* * * * *